US005927264A

United States Patent [19]

Worley

[11] Patent Number: 5,927,264

[45] Date of Patent: Jul. 27, 1999

[54] EXTENDED WEAR STONE POLISHING DISK

[76] Inventor: Kenneth Worley, P.O. Box 59, Elberton, Ga. 30635

[21] Appl. No.: 09/004,547

[22] Filed: Jan. 8, 1998

[51] Int. Cl.[6] ..... B24B 41/00; B28D 5/04

[52] U.S. Cl. ..... 125/36; 451/342; 451/360; 451/495; 451/548

[58] Field of Search ..... 125/36; 451/342, 451/360, 495, 508, 509, 510, 530, 548

[56] References Cited

U.S. PATENT DOCUMENTS

| | | | |
|---|---|---|---|
| 2,097,806 | 11/1937 | Weidrich . | |
| 2,174,902 | 10/1939 | Stratford | 451/510 |
| 2,567,782 | 9/1951 | Rhees | 451/510 |
| 2,800,751 | 7/1957 | Brucker | 451/509 |
| 3,745,719 | 7/1973 | Oswald | 451/548 |
| 3,866,361 | 2/1975 | Mauck | 451/510 X |
| 3,932,966 | 1/1976 | Stern | 451/488 |
| 4,222,204 | 9/1980 | Benner | 451/508 X |
| 4,622,783 | 11/1986 | Konig et al. | 451/508 |
| 4,692,958 | 9/1987 | McMakin | 451/508 X |
| 4,831,789 | 5/1989 | Herbin et al. | 451/495 |
| 5,197,249 | 3/1993 | Wiand | 451/529 |

FOREIGN PATENT DOCUMENTS

| | | | |
|---|---|---|---|
| 503516 | 6/1954 | Canada | 451/510 |
| 746975 | 3/1956 | United Kingdom | 451/508 |

*Primary Examiner*—Timothy V. Eley
*Attorney, Agent, or Firm*—Henry S. Jaudon; Cort Flint

[57] ABSTRACT

The invention is directed to an extended wear stone polishing disk for use with an automatic polishing head. The disk consists of a first plastic plate of prescribed flexibility having a pair of mounting studs secures therewith to extend above its upper face. The mounting studs form a quick release securing members which locks with the mounting plate and secures it with the first plate. A second plastic plate and a resilient foam pad secured there between. A plurality of diamond faced grinding and polishing segments are secured with the lower face of the second plate in a prescribed pattern to form a polishing face. In use, the resilient foam pad evenly distributes resistance to pressure applied against the second plate during polishing while allowing the polishing face to distort in conformance with the contour of the surface being polished.

19 Claims, 4 Drawing Sheets

PRIOR ART

EXTENDED WEAR STONE POLISHING DISK

BACKGROUND OF THE INVENTION

The instant invention is directed to a grinding and polishing disk constructed to afford even and extended wear of the grinding or polishing segments. The polishing disk is particularly well suited for polishing edge or end surfaces which are narrow and may be contoured.

The most prevalent stone polishing disk in use today is shown in FIG. 1. The device consists of a heavy non-flexible metal upper plate and a spaced flexible metal lower plate which carries 2" polishing segments. Spaced springs separate the upper and lower plates. Because the springs are spaced, resistance against pressure applied to the lower face varies across its surface area. This uneven resistance produces uneven wear on the grinding elements and makes it more difficult to produce a polished surface absent of streaks or scratches. Another factor resulting in the uneven wear of the grinding segments or pods is their 2" size. Because the diameter of the disk is relatively small, between 5" and 7", it is difficult to obtain a satisfactory pattern using 2" grinding segments.

U.S. Pat. No. 3,745,719 shows a variation of the above described arrangement. This patent attempts to overcome the effect of uneven wear of the grinding segments by placing carbide buttons over the polishing surface.

U.S. Pat. No. 5,197,249 shows another known arrangement wherein non-abrasive load bearing segments are integrated with the grinding segments over the polishing face.

U.S. Pat. No. 3,517,466 discloses yet another arrangement including circular grinding segments separated from a steel mounting plate by a flexible pad.

It is the object of the instant invention to overcome the limitations and disadvantages of the known stone grinding and polishing disk by providing a disk with an extended life span due to reduced wear.

Another object of the invention is to provide a grinding and polishing disk having 1" grinding segments or pods arranged in a selected pattern.

Another object of the invention is to provide a grinding and polishing disk which applies even and varying resistance to flex over its polishing area.

Another object of the invention is to provide a grinding and polishing disk to include an adjustment member capable of varying the flex area of the polishing area.

Another object of the invention is the provision of a grinding and polishing disk which produces a minimum of scratches during polishing.

Another object of the invention is a grinding and polishing disk which eliminates the forming of streaks in the polished surface.

Another object of the invention is to provide a polishing disk which is made substantially of synthetic materials.

SUMMARY OF THE INVENTION

The instant invention is directed to a stone polishing and grinding disk for use with an automatic polishing head capable of extended use. This includes a first plastic plate of prescribed flexibility having a pair of mounting studs secured with one side to extend above the upper face of the first disk. The mounting studs are provided to secure with a polishing head of an automatic polisher.

A second plastic plate of prescribed flexibility is provided. A plurality of diamond faced grinding segments are secured with the lower face of the second plate in a prescribed pattern forming a polishing face.

A resilient foam pad is located between the first and second plates forming a three tiered composite unit. The resilient foam pad functions to apply an even resistance to pressure between and against the first and second plates during polishing allowing the polishing face to be flexed evenly in conformance to the contour of the surface being polished. The uniform, even pressure on the grinding segments produces more even wear of the segments which results in extended life of the segments and, therefore, the polishing disk. More even wear also results in a more uniform polished surface.

It has been found that the plates, or at least one of the plates, may be made of a thin metal sheet, i.e., approximately 1/16" thick. The primary requirement when using metal sheets is that the degree of flexibility provided by the plastic sheets be retained.

A limiting plate may be positioned on the upper surface of the first plate and held in position by said mounting studs. The limiting plate acts to adjust radially the area of flex of the upper plate which is normally controlled by the diameter of the mounting plate of the polishing head. Normally the limiting plate is of less diameter than the mounting plate which provides that the flex area of the first plate is increased However, the diameter of the limiting plate could be of greater diameter than the mounting head, which would further limit the flex area of the first plate.

The foam pad comprises of a polyethylene sheet between 1/4" and 1" thick. The plastic forming the upper plate is preferably a semi-rigid acrylic plastic sheet formed to at least 1/8" thickness. The lower plate is formed of the same material and is between 1/8" and 1/4" thick. The diameters of the foam pad and the upper and lower plates are between 5"–24" with 6" and 7" diameters being most prevalent.

The diamond segments are about 1" in length and comprise a diamond compound face secured with a metal base. The metal base in turn is secured with the lower plate. Normally lock screws, which pass through the lower plate, are employed to removably secure the segments with the lower plate.

In an alternative arrangement, buffing pads may be substituted for the grinding segments and arranged to cover completely the second plate.

The invention includes the method of producing a contoured surface stone grinding and polishing disk for use with an automatic polisher having extended wear life comprising the steps of:

- providing first and second synthetic plastic plates of selected thickness and resilience;
- providing a synthetic foam pad of a thickness at least twice that of the plates and of a desired resiliency and securing opposing faces of the plates with the opposite faces of the pad to provide uniform engagement of the entire area of the plates;
- providing and securing a pair of mounting members with the first plate;
- providing a plurality of diamond segments and securing the segments in a desired pattern in four repeats over the outer surface of the second plate; whereby,
- the pad acts to apply pressure evenly over the entire area of the first and second plates as they respond to the pressure of polishing and to the contoured surface of the stone bringing about even wear of the diamond segments.

DESCRIPTION OF A PREFERRED EMBODIMENT

Figure 1:
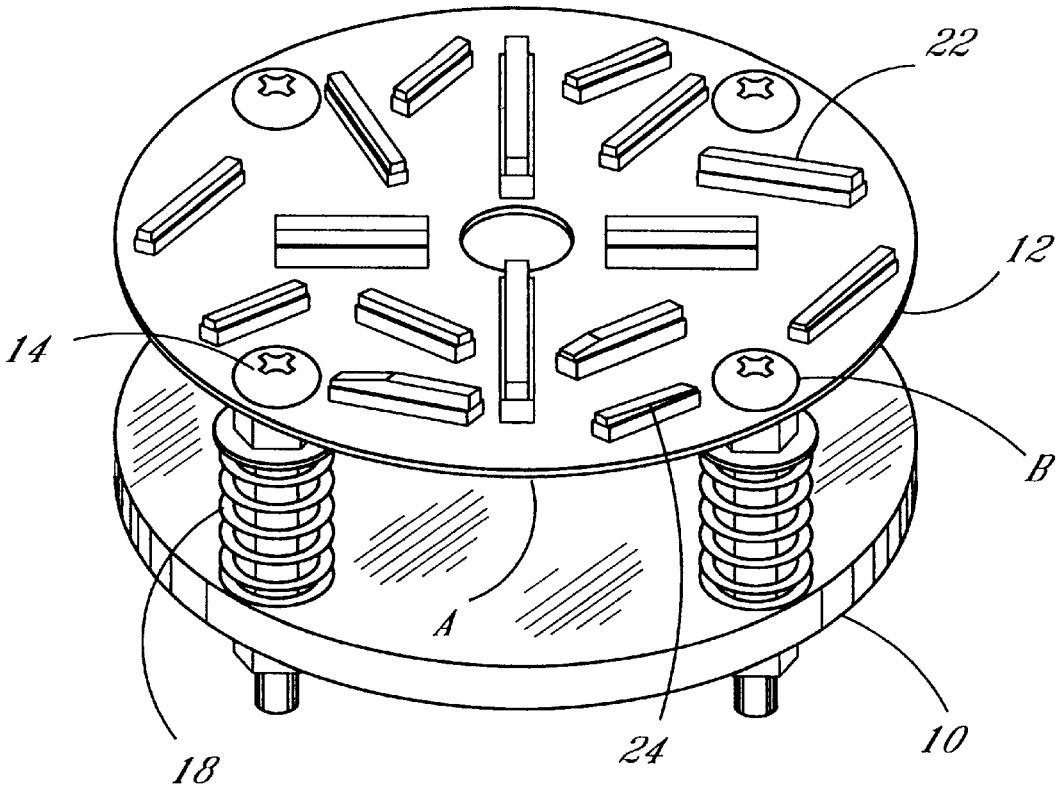
FIG. 1 PRIOR ART
FIG. 1 is a perspective view of the polishing face of a conventional disk for use with automatic grinding and polishing machines.
Figure 2:
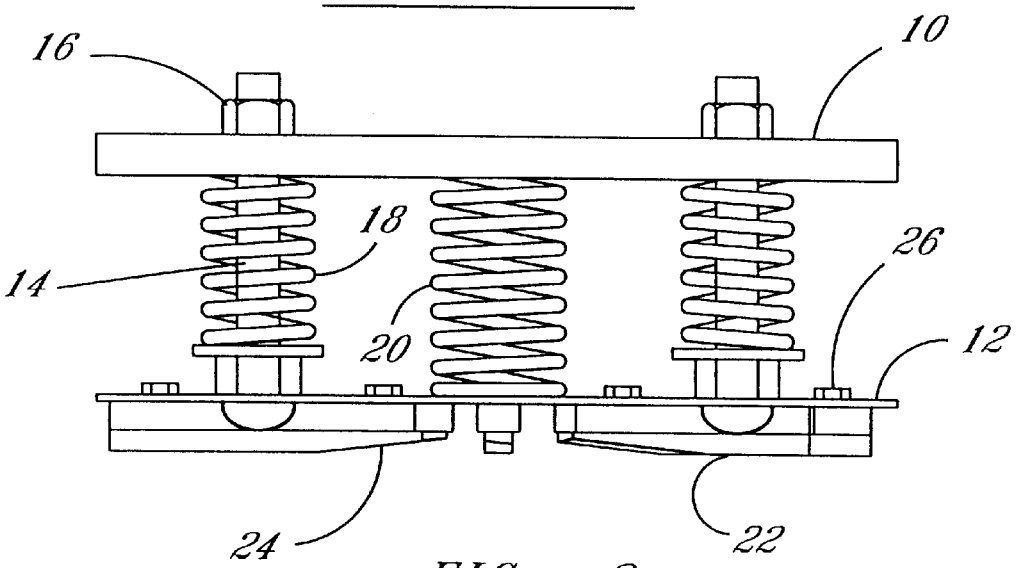
FIG. 2 is a side view of the grinding and polishing disk of FIG. 1.

Polishing and grinding disk for finishing and polishing stone markers, building blocks, memorials, etc. have long been know in the industry. Likewise, polishing disk for use with automatic polishing machines for grinding and polishing top and edge surfaces are well known. One of the most common known grinding and polishing disk is shown in FIGS. 1 and 2 and comprises an upper mounting plate 10 and a lower support plate 12. Bolts 14 carrying spacing springs 18 secure plates 10 and 12 in spaced relationship about the periphery. Optionally a central spring 20 may be added. Nuts 16 are used to provide easy disassembly.

Mounting plate 10 carries a pair of locking studs (not shown) which lock with the polishing head of the automatic polisher with a quick release engagement.

Support surface 12 has a plurality of diamond pods or segments 22 secured thereto by screws 26. Diamond pods 22 comprise the grinding and polishing elements which grind and polish the stone surface to its finished or substantially finished condition. They are normally constructed to include a steel base carrying a diamond compound segment. The diamond segment or pod is 2" by ¼" by ¼" and the base is slightly larger. These diamond pods are expensive items, costing about $18 per pod, while they wear at a relatively high rate.

A major problem contributing to the high rate of wear is uneven wear. As shown in FIGS. 1 and 2 pods 22 tend to wear unevenly toward spacing members 14 and 18. This is because, during polishing, the pressure applied against each pad varies in proportion to its relationship with the spacing members.

In operation, the polishing head forces the grinding and polishing disk against the surface of the stone with up to 300 pounds of pressure. The pressure varies with the diameter of the polishing disk, i.e., the larger diameter disk requires more pressure. The pressure causes plate 12 in areas A spaced between bolts 14 to flex away relieving some of the pressure on at least a portion of pods 22 in that area. Areas B, adjacent bolts 14 flex not at all or to a lesser degree depending on the pressure applied. This unevenness of pressure causes pods 22 to wear unevenly toward areas B as shown at 24. When an edge of the pod wears into its steel base, it must be replaced. Uneven wear also causes streaks and scratches in the polished surface.

Figure 3:
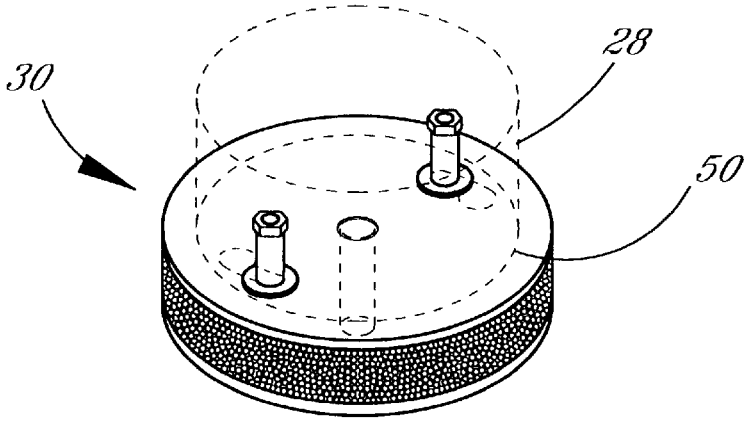
FIG. 3 is a perspective view showing the polishing disk of the invention engaged with the polishing head.
Figure 4:
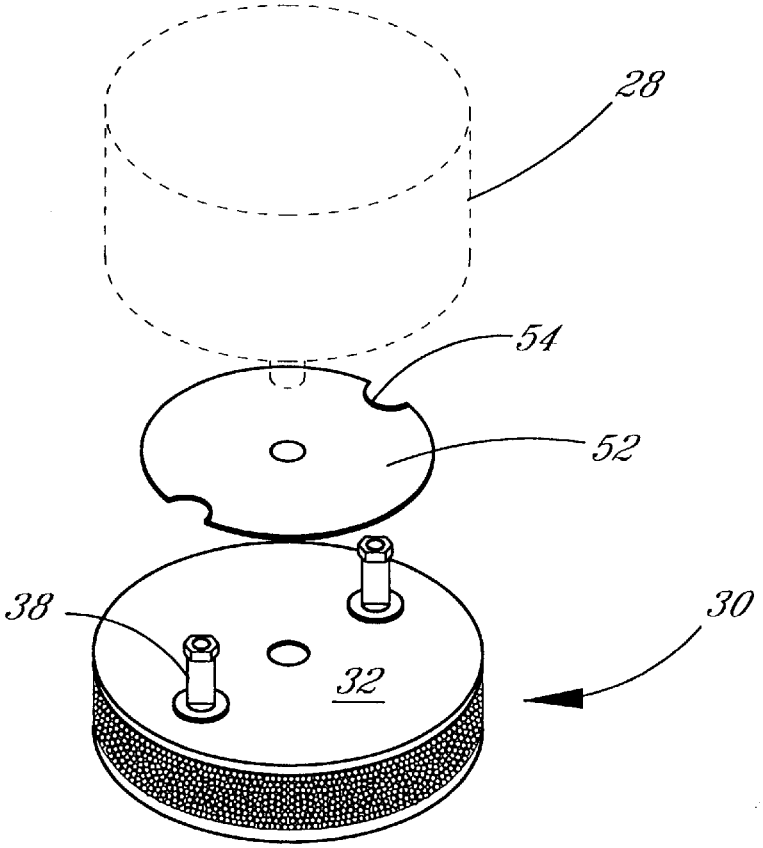
FIG. 4 is an exploded perspective view showing the polishing disk of the invention, a spacer and the polishing head in relative positions.

FIGS. 3 and 4 show the grinding and polishing head of the invention which is intended to overcome the drawbacks discussed with the prior art, primarily to reduce cost by providing a polishing surface which operates with less diamonds and yet has an operating life equal that of a conventional polishing face. The polishing head of the invention produces fewer lines and scratches on the surface being polished, reducing work time and, thereby, cost.

Figure 5:
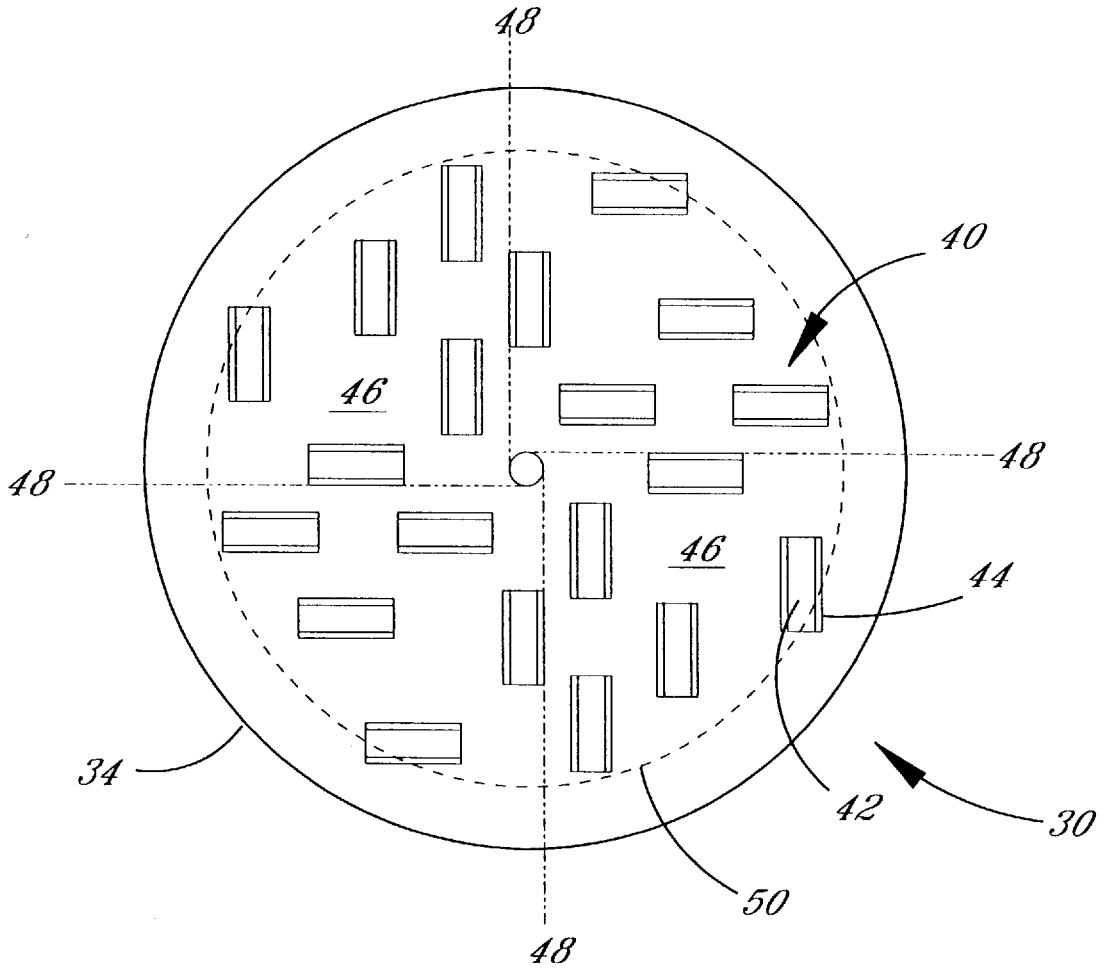
FIG. 5 is a bottom view of the grinding and polishing disk of the invention.
Figure 6:
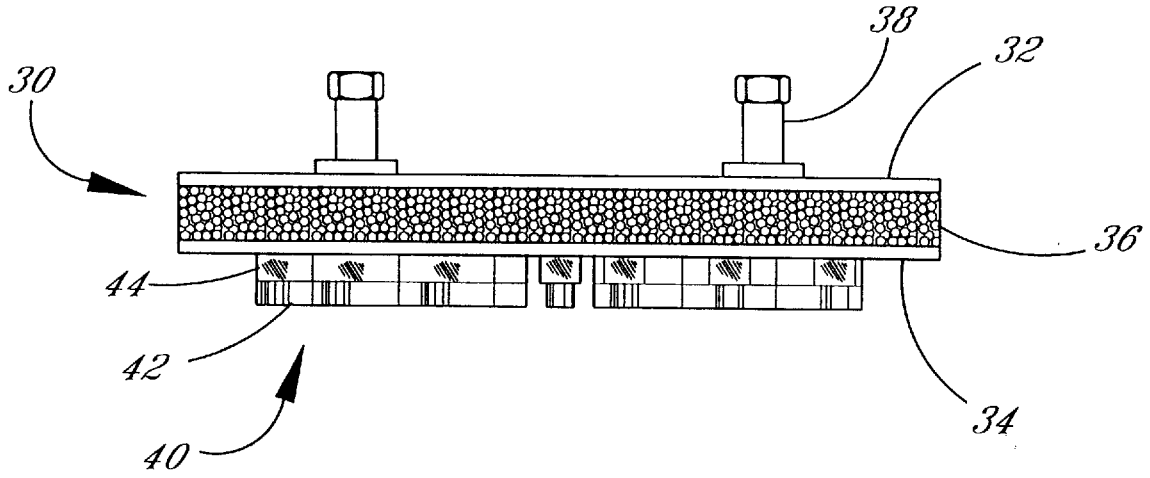
FIG. 6 is a side view of the grinding and polishing disk of FIG. 5.

Turning now to FIGS. 3–6 the instant invention will be described in detail. In FIG. 3, polishing head 28 which is schematically shown, is engaged with polishing disk 30 constructed in accordance with the invention. Disk 30, as best shown in FIGS. 5 and 6, comprises an upper mounting plate 32 which is formed of a semi-flexible acrylic plastic sheet of any suitable material such as PLEXIGLAS or LEXAN, both of which are commercially available. Plate 32 is preferable ⅛" thick with a diameter ranging between 5" and 24". Spaced below upper mounting plate 32 is flexible lower support plate 34 formed of the same plastic material as plate 32. Support plate 34 is sized to match mounting plate 32, however, under certain conditions it could be up to twice as thick.

Secured to opposing faces of plates 32 and 34 is a polyurethane foam pad 36 which is at least ½" thick, however, depending upon the intended use, pad 36 could be up to 1" thicker or ¼" thinner. Pad 36 is compressible up to 50% by an application of the force required to accomplish satisfactory polishing and grinding and also possesses near 100% recovery capability. The pressure applied and the compressibility selected also depends upon the diameter of the polishing disk and the intended function. The product is commercially available by PSC FABRICATING of Louisville, Ky.

Upper plate 32 carries a pair of locking studs 38 which lock with the polishing head in the usual manner. Each stud 38 comprises a bolt which passes from the underside through plate 32 and is secured thereto with a T-lock. A nut is secured to the end of the bolt and secures the bolt and T-lock.

Support or lower plate 34 has a plurality of diamond pods or segments 40 secured thereto, by screws or other suitable means such as gluing, and arranged in a selected pattern.

Each diamond pod 40 comprises a grinding or polishing section 42 formed of diamond composition mounted on a metal base 44, usually steel. Each section 42 is 1" long, ¼" high and ¼" wide. Base 44 is of equal size or slightly larger in each dimension as shown.

The lower surface of plate 34 is divided into four equal segments 46 as indicated by lines 48. A flex line, indicated by broken line 50, extends around the surface area adjacent its periphery. Pods 40 are arranged in a repeated selected pattern within each segment 46 and relative to flex line 50. It is especially important that all of the pads 40 nearest the flex line be adequately spaced to allow sufficient flexings. Inadequate flexing causes excessive wear and streaking or lines in the surface being polished. As can be seen, there are five pods 40 in each area 46. The pods are arranged with a higher density toward the inner portion of area 46. This is to provide greater flexibility between the outer pods.

The pattern shown is for a 6" disk. Larger disks, such as an 8" disk, would use at least one additional segment provided in each area 46 while a 10" disk would require at least two additional segments. The number of diamond segments increases progressively as the diameter of the disk increases.

Flex line 50 represents that point from which upper plate 32 retains a degree of flexibility outward toward its periphery. Inwardly of flex line 50, upper plate 32 provides a rigid support for the polishing disk. This area of rigidity is normally provided by polishing head 28 which engages flush against the upper surface of plate 32 when locked in position as shown in FIG. 3. The periphery of polishing head 28, which is less than the periphery of polishing disk 30 establishes the location of flex line 50.

In some instances it may be desirable that the location of flex line 50 be outside or inside the periphery of polishing head 28. Spacer or limiting plate 52 is provided for that purpose.

Spacer or limiting plate 52 may be formed of the same material as plates 32 and 34. It is normally ⅛" thick with a diameter of about 1" less than the diameter of polishing head 28. Spacer or limiting plate 52 is formed with locking ears 54 which engage with post 38 which securely positions the spacer in position flush with the upper surface of plate 32.

In operation polishing head 28 is spaced from plate 32 by spacer 52. The periphery of spacer 52 now forms the flex line inside the radius of polishing head 28.

In some instances, particularly when using larger polishing heads, it may be desirable that the flex line extend beyond the periphery of polishing head 28. In these instances a spacer 52 may be provided with a diameter of up to 1" less than that of polishing head 30.

In operation, a rotating polishing head 28 carrying disk 30 is brought into position against the stone surface under pressure, usually around 75 pounds per square inch. The pressure causes pad 36 to compress. Because pad 36 is supported uniformly between both plates 32 and 34 the pressure is distributed evenly over the entire polishing surface which allows pods 40 to wear evenly and uniformly over their entire contact surface. Because pods 40 are evenly pressed against the surface being ground and polished more of the diamond surface of each pad performs the grinding and polishing operation. This provides longer wear even though the surface area is half the size of a standard 2" pad. Also, even pressure produces fewer lines and scratches in the polished surface.

In operation, the polishing head moves in reciprocating passes over the stone surface. The second pass, slightly overlaps the first pass and the third overlaps a portion of does the second pass etc. On the second and all succeeding passes there is a slight disparity or ridge across the surface being ground at the point of overlap. In order that the edge pods of the polishing face do not cut a groove in the stone surface a degree of flexibility in excess of that allowed by foam pad 36 is needed. This extra degree of flexibility is provided in the area outside of flex line 50 where the flexible plates 32 and 34 are caused to be slightly flexed upward. This action allows the polishing surface to adjust and prevents the formation of lines.

Figure 7:
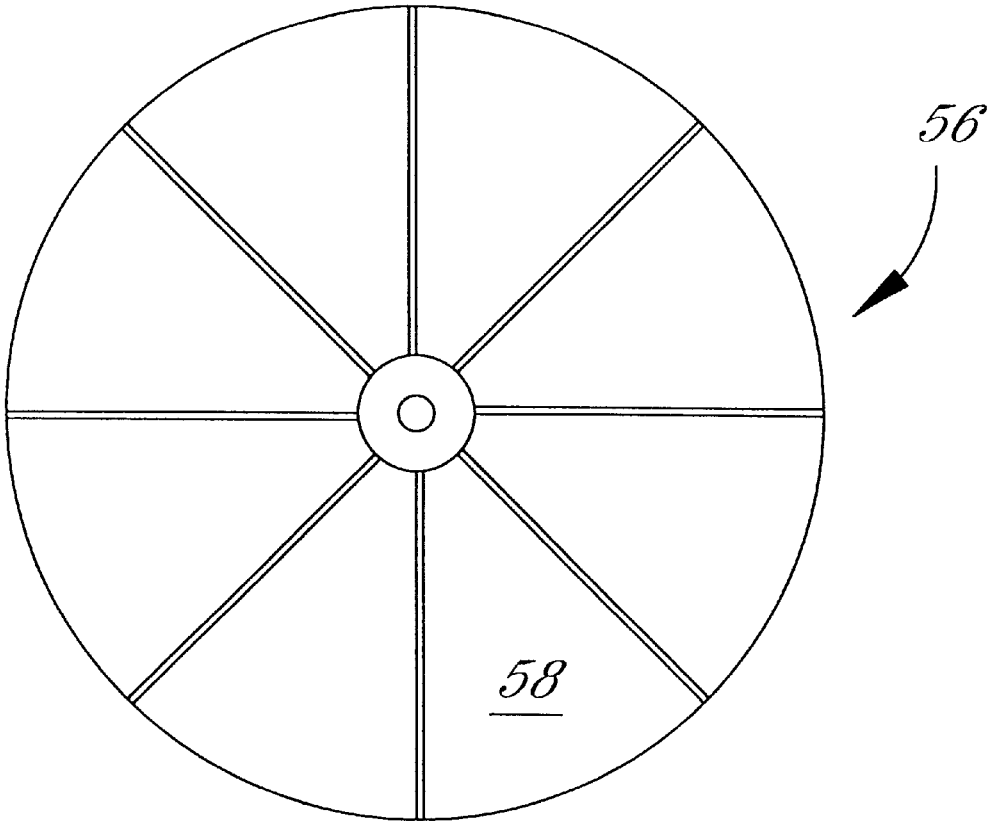
FIG. 7 is a bottom view of an alternative arrangement of the invention in which the polishing face comprises buffing pads.
Figure 8:
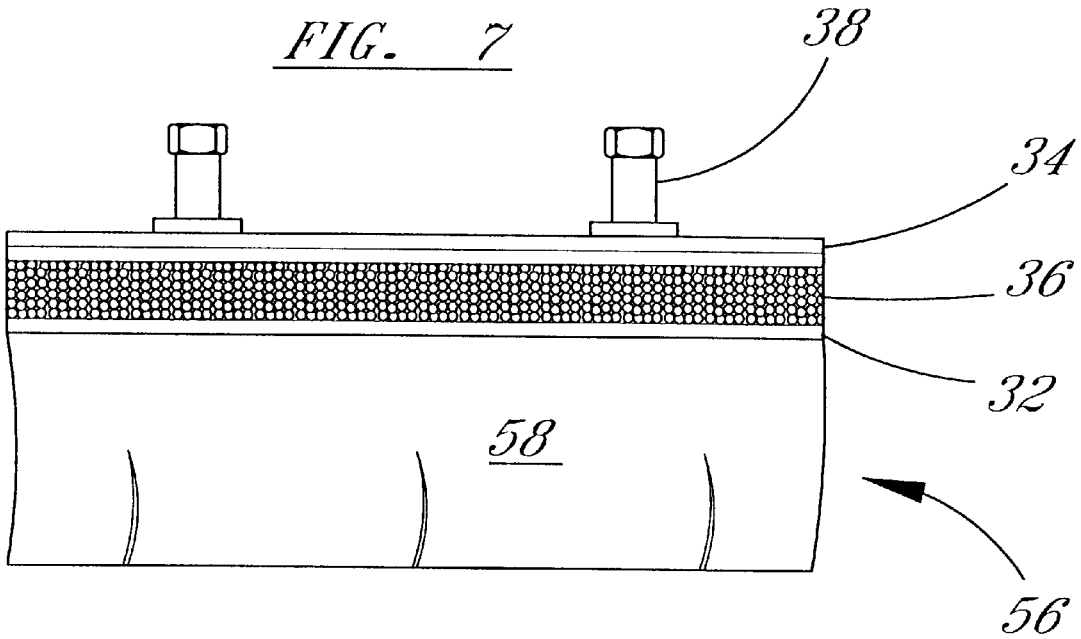
FIG. 8 is a side view of the arrangement shown in FIG. 7.

FIGS. 7 and 8 show a second embodiment of the polishing disk. In this arrangement a buffing polishing disk 56 is formed by securing a standard wool buffing pad 58 with lower plate 32. The remainder of this polishing disk is as disk 30, comprising upper plate 34, foam pad 36, and locking studs 38.

Pad 58 is divided into a plurality of wedge shaped sections by grooves 60 providing a plurality of pad segments.

The buffing operation is carried out more smoothly and evenly due to the flexibility of the pad due to the individual segments and the evenness of pressure over the buffing surface brought about by foam pad 36.

While a preferred embodiment of the invention has been described using specific terms, such description is for illustrative purposes only, and it is to be understood that changes and variations may be made without departing from the spirit or scope of the following claims.

What is claimed is:

1. An extended wear stone polishing disk for use with an automatic polishing head comprising:

a first plastic plate of prescribed flexibility having an upper face and a lower face;

a pair of mounting studs secured with said first plate to extend above said upper face, said mounting studs forming quick release securing members for locking said polishing head in engagement with said first plate;

a resilient foam pad having an upper and a lower face, said upper face of said foam pad being secured with said lower face of said upper plate;

a second plastic plate of prescribed flexibility having an upper face and a lower face, said upper face of said second plate being secured with said lower face of said foam pad;

a plurality of polishing elements secured with said lower face of said second plate in a prescribed pattern forming a polishing face; whereby in use, said resilient foam pad applies an even resistance against pressure applied to said polishing disk while allowing said polishing face to distort in conformance with the contour of the surface being polished providing even wear and extended life of said grinding segments.

2. The stone polishing disk of claim 1 wherein said foam pad comprises a ½" thick polyethylene sheet.

3. The stone polishing disk of claim 2 wherein said upper plate comprises a semi-rigid sheet of acrylic plastic at least ⅛" thick.

4. The stone polishing disk of claim 2 wherein said lower plate comprises a semi-rigid sheet of acrylic plastic at least ⅛" thick.

5. The stone polishing disk of claim 4 wherein said lower plate is ¼" thick.

6. The stone polishing disk of claim 1 wherein said polishing elements comprise diamond segments of about 1" length.

7. The stone polishing disk of claim 6 wherein each said diamond segment comprise a diamond compound face secured with a metal base, and lock screws passing through said lower plate secure said metal base with said lower plate.

8. The stone grinding and polishing disk of claim 6 wherein said diamond segments are uniformly arranged over said lower face in four repeats of a prescribed pattern.

9. The stone polishing disk of claim 1 wherein said pad is at least 50% compressible under pressure of no more than 300 pounds.

10. The polishing disk of claim 1 wherein said polishing elements comprise buffing segments.

11. The polishing disk of claim 10 wherein said buffing segments cover completely said lower face of said second plate.

12. A polishing disk having a variable area of flexibility in combination with an automatic stone polishing machine having a circular polishing head having a first diameter, said disk comprising:

a flexible first plate formed of an acrylic plastic sheet having a second diameter, said second diameter being greater than said first diameter of said polishing head;

a flexible second plate formed of an acrylic plastic sheet and located below said first plate;

a polyurethane foam pad secured with opposing faces of said first and second plates forming said mounting disk;

a pair of spaced mounting studs carried by said first plate removably locking said disk in engagement with said polishing head;

a plurality of connector elements carried by said second plate mounting polishing elements with said second plate; whereby, a flex line corresponding with the periphery of said polishing head is established, said flex line defining an area of flexibility of said first plate.

13. The stone polishing disk of claim 12 wherein said disk is between 5" and 24" in diameter and said polishing head is between 5" and 6" in diameter.

14. The stone polishing disk of claim 12 including a circular limiting plate having a selected diameter different from said first and second diameters located between said polishing head and said upper plate, said limiting plate acting to reestablish said flex line selectively in dependence with a selected diameter of said limiting plate.

15. The stone polishing disk of claim 14 wherein said limiting plate includes locking elements which engage and lock with said mounting studs in a stationarily position relative to said first plate.

16. The stone polishing disk of claim 14 wherein said selected diameter of said limiting plate is less than said first diameter of said polishing head whereby said area of flexibility of said first plate is increased.

17. The polishing disk of claim 12 wherein said polishing elements comprise diamond segments of about 1" length arranged in a specific pattern over said second plate.

18. The polishing disk of claim 17 wherein said pattern repeats four times.

19. A method of producing an extended wear stone grinding and polishing disk for polishing edges and contoured surfaces for use with an automatic polisher comprising:

providing first and second synthetic plastic plates of selected thickness and resilience each said plate having inner and outer faces;

providing a synthetic foam pad of a thickness at least twice the combined thickness of said plates and of a desired resiliency and securing said pad with said inner faces of said plates to be engaged over the entire area of said inner faces;

providing a spaced pair of mounting members and securing said mounting members with said first plate;

providing a plurality of diamond segments and arranging said segments in a selected pattern over the outer face of said second plate; whereby during polishing, said foam pad may act to evenly distribute resistance to pressure over said second plate promoting even wear of said diamond segments and extended life of said polishing disk.

* * * * *